US005272293A

United States Patent [19]

Abbin et al.

[11] Patent Number: 5,272,293

[45] Date of Patent: Dec. 21, 1993

[54] ROLAMITE ACCELERATION SENSOR

[75] Inventors: Joseph P. Abbin; Clifton F. Briner; Samuel B. Martin, all of Albuquerque, N. Mex.

[73] Assignee: The United States of America as represented by the United States Department of Energy, Washington, D.C.

[21] Appl. No.: 968,563

[22] Filed: Oct. 29, 1992

[51] Int. Cl.[5] ..... H01H 35/14

[52] U.S. Cl. ..... 200/61.53; 200/61.08; 200/503

[58] Field of Search ..... 200/61.45 R, 61.45 M, 200/61.53, 503, 61.08

[56] References Cited

U.S. PATENT DOCUMENTS

| | | | |
|---|---|---|---|
| 2,802,073 | 8/1957 | Simon | 200/61.08 |
| 3,452,175 | 6/1969 | Wilkes | 200/503 |
| 3,567,881 | 3/1971 | Duimstra et al. | 200/61.53 |
| 3,688,063 | 8/1972 | Bell | 200/61.53 |
| 3,859,488 | 1/1975 | Jones | 200/503 |
| 4,092,926 | 6/1978 | Bell | 102/204 |
| 4,099,038 | 7/1978 | Purdy | 200/61.08 |
| 4,116,132 | 9/1978 | Bell | 102/200 |
| 4,129,759 | 12/1978 | Hug | 200/83 R |
| 4,157,462 | 6/1979 | Blanchard | 200/61.45 R |
| 4,246,456 | 1/1981 | Leonard | 200/61.08 |
| 4,698,623 | 10/1987 | Smith | 340/665 |

OTHER PUBLICATIONS

Etheridge, "Rolamite Applications Are Few, But New Uses May Be Found," *Lab News*, Sandia National Laboratories, vol. 41, No. 12, pp. 5–10, Jun. 16, 1989.

*Introduction to the Rolamite Mechanical Design Concept*, SC-M-68-232B, revised Apr. 1972.

*Primary Examiner*—J. R. Scott

*Attorney, Agent, or Firm*—Karla Ojanen; James H. Chafin; William R. Moser

[57] ABSTRACT

A rolamite acceleration sensor which has a failsafe feature including a housing, a pair of rollers, a tension band wrapped in an S shaped fashion around the rollers, wherein the band has a force-generation cut out and a failsafe cut out or weak portion. The failsafe cut out or weak portion breaks when the sensor is subjected to an excessive acceleration so that the sensor fails in an open circuit (non-conducting) state permanently.

11 Claims, 2 Drawing Sheets

ROLAMITE ACCELERATION SENSOR

The United States Government has rights in this invention pursuant to Contract No. DE-AC04-76DP00789 between the U.S. Department of Energy and American Telephone and Telegraph Company.

BACKGROUND

1. Field of the Invention

The present invention relates generally to a roller band type (Rolamite) acceleration sensor, and in particular to a roller band acceleration sensor which has a failsafe feature.

2. Description of Related Art

Roller band type acceleration sensors (known as "Rolamite") have many uses. These sensors have a low coefficient of friction which makes them ideal for many applications because very little energy is required to operate the acceleration sensor.

Several patents disclose a basic roller band type structure. The first Rolamite patent was granted on Jun. 24, 1969 to Donald F. Wilkes as U.S. Pat. No. 3,452,175 and is assigned to the U.S. Department of Energy and is incorporated herein by reference. The Wilkes patent discloses the basic rolamite design which includes a two roller system and a tension band in between the two rollers. A switch is provided at one end of the rolamite housing. Various functional cut outs within the band are shown which effect the characteristics of the Rolamite.

U.S. Pat. No. 3,567,881 to Duimstra et al, which is incorporated herein by reference and assigned to the same assignee as this application, discloses a roller band inertial switch which has a housing, a pair of rollers, a tension band intertwined between the rollers, a reset end cap and a switch end. However, neither of these patents disclose a way of preventing the Rolamite from failing in a conducting position should an excessive acceleration occur.

Rolamite roller band acceleration sensors have been fabricated in a number of ways over the years. U.S. Pat. No. 3,688,063 to Bell discloses a crash sensing switch which is a variation of the original roller band type design. Bell discloses a switch which includes a resettable latch, a force biasing adjustment means and a separate switching mechanism which does not directly use the band to make an electrical contact as was done in the original rolamite patent to Wilkes. This switch does not provide a mechanism for preventing a sudden excessive acceleration from causing the switch to be jammed in a conducting or closed position.

U.S. Pat. No. 4,116,132 to Bell discloses an inertial sensor which includes a rolamite device. A cocked spring mechanism releases the sensor depending on the amount of acceleration. The sensor also includes a safety interlock mechanism. Energy to engage the sensor is stored mechanically in the cocked spring which must be overcome. If the band within the sensor breaks, the energy of the spring is released without enabling the sensor or actuating the switch. The rolamite device in this patent is not actually part of the electrical circuit and thus only indirectly prevents an electrical circuit from being closed should an excessive acceleration occur.

A Rolamite has a band which may break because of excessive acceleration. This breaking can prevent the sensor or switch from being activated or cause sticking in a closed (conductive) position. A number of devices which have frangible elements are known in other arts. U.S. Pat. No. 2,802,073 to Simon discloses an auto safety belt which has a conductive band which permits power to be transmitted through the band when the seat belt is fastened. The belt also includes a disconnect feature which interrupts power when a given tension is exceeded. Thus, the band is a part of an electrical circuit which is broken when excessive forces occur. This disconnect feature is resettable and may reclose once the excessive force is relieved. This makes the belt unpredictable. Moreover, this device does not act as an acceleration sensor prior to breakage.

U.S. Pat. No. 4,698,623 to Smith discloses an overload detecting apparatus which incorporates a frangible container of a visibly dense, conductive liquid whose presence is sensed electrically/optically when the container is broken. The container has a weakened area which fractures when a certain level of acceleration occurs. This apparatus does not act as an acceleration sensor prior to breakage and requires a liquid which could cause reliability and leakage problems as well as being expensive to contain.

SUMMARY OF THE PRESENT INVENTION

Therefore, it is an object of the present invention to provide an acceleration sensor which overcomes all of the problems of the related art, and in particular provides an acceleration sensor which has a failsafe feature built into the roller band type acceleration sensor.

It is another object of the present invention to provide an acceleration sensor of the roller band type wherein the failsafe feature is easy to manufacture.

It is a further object of the present invention to provide an acceleration sensor of the Rolamite type which will permanently fail in a safe condition when an excessive acceleration is applied to the sensor.

It is a further object of the present invention to provide a failsafe feature which is a fundamental part of the actual electrical switch circuit.

It is a further object of the present invention to provide an acceleration sensor which acts as a sensor until breakage occurs.

The present invention is a roller band type acceleration sensor which includes a frangible conductive band. The frangible conductive band has a cut out portion or a weak portion which allows the sensor to have a preset acceleration at which failure occurs. The sensor also has an insulative guard which prevents accidental reclosure of the sensor after failure.

BRIEF DESCRIPTION OF THE DRAWINGS

These and other objects, features and advantages of the present invention will become apparent to one of ordinary skill in the art from the following description of the preferred embodiment of the present invention and from the drawings, wherein.

DETAILED DESCRIPTION OF THE PREFERRED EMBODIMENT

With reference to the figures, wherein like numerals denote like parts, the preferred embodiment of the present invention will now be described.

Figure 1:
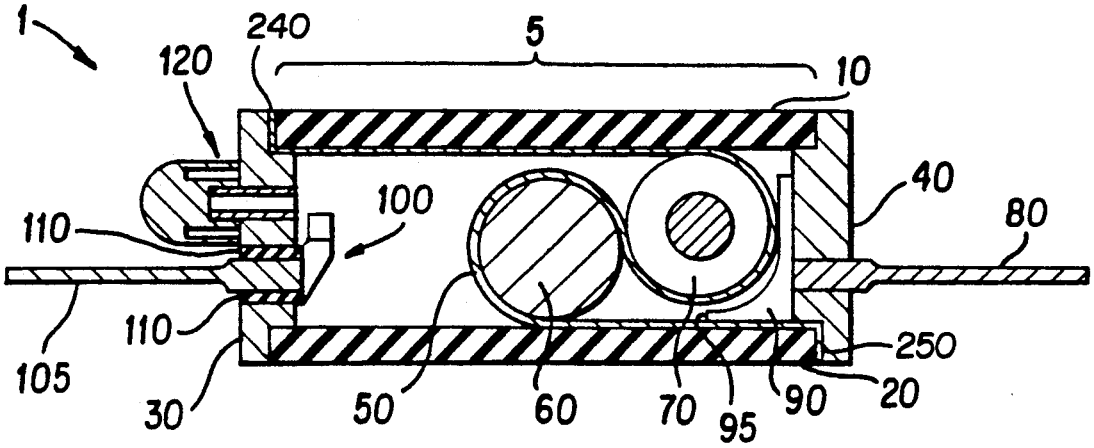
FIG. 1 is a side view of a failsafe roller band type acceleration sensor which is a preferred embodiment of the present invention.

In FIG. 1, a roller band acceleration sensor, also called a Rolamite switch or Rolamite sensor, includes housing 5, actuate end cap 30, reset end cap 40, band 50, actuate roller 60, reset roller 70, and guard 90. Housing 5 includes top wall 10, bottom wall 20, and two side walls (not shown for clarity). Housing 5 is formed from an insulating material, for example glass or plastic. Actuate end cap 30 and reset end cap 40 are formed from conductive materials, preferably metal, for example, Kovar (an alloy of nickel and iron). Reset end cap 40 preferably includes reset pin 80, also of conductive material connected to reset end cap 40. Band 50 is formed of conductive material, preferably steel. Band 50 is fastened to reset end cap 40, preferably by welding, to form an electrically conductive and mechanical bond at reset end 250 (in FIG. 2). Band 50 is looped in a generally S-shaped fashion about rollers 60 and 70 and fastened in a joint between top wall 10 and actuate end cap 30, preferably by gluing, at actuate end 240 of band 50 (in FIG. 2). Thus, reset end cap 40 is electrically conductive with band 50.

The size of the band is generally defined by the housing and roller size and mass and the general size of the Rolamite switch. The band is approximately 2 inches long, 0.2 inches wide and 0.001 inches thick but can have other dimensions depending upon the application. The band is made from a high-yield strength material which is under bending and tension when looped around rollers 60 and 70 and fastened at both ends. Although, steel is a preferred material, other materials may be used. It is preferable that the band material be resistant to deformation so that the material will not creep or yield with time.

Reset end cap 40 may be, and preferably is, fitted with reset pin 80 made from conductive material, preferably Kovar and electrically conductive with reset end cap 40. Kovar is preferred where indicated throughout this disclosure because it has a thermal coefficient of expansion similar to the thermal coefficient of expansion of glass to achieve quality bonding. It is preferred that the thermal coefficient of expansion of end caps 30 and 40 and reset pin 80 be similar to the thermal coefficient of expansion of housing 5. Reset pin 80 is preferably brazed to reset end cap 40.

Guard 90 is disposed between reset end cap 40 and a portion of band 50 looped around reset roller 70. Guard 90 is formed of an insulating material, preferably diallyl phthalate, so as to insulate the portion of band 50 looped around reset roller 70 from reset end cap 40.

Contact 100 is formed on, and insulated from, actuate end cap 30. Actuate contact pin 105 is surrounded by insulator 110 and disposed in a hole formed through actuate end cap 30 so that actuate contact pin 105 is electrically conductive with contact 100 and insulated from actuate end cap 30. Actuate end cap 30 and actuate contact pin 105 are preferably formed from conductive materials having a coefficient of thermal expansion similar to a coefficient of thermal expansion of insulator 110. Preferably actuate contact pin 105 and actuate end cap 30 are formed from Kovar and insulator 110 is formed from glass.

In the operation of the Rolamite sensor, band 50 acts as a spring to urge rollers 60 and 70 toward reset end cap 40. When housing 5, and all components contained therein, are subjected to an acceleration in a direction that extends from actuate end cap 30 toward reset end cap 40, the inertia of rollers 60 and 70 cause the pair of rollers to move relative to housing 5 in a direction from reset end cap 40 toward actuate end cap 30, and the band 50 acting as a spring to oppose the movement of rollers 60 and 70. A predetermined value of acceleration of housing 5 is required to overcome the opposing spring-like force asserted by band 50 so as to cause rollers 60 and 70 to move so that a portion of band 50 looped around actuate roller 60 makes contact with contact 100. At the predetermined value of acceleration electrical conduction is achieved between reset pin 80, through reset end cap 40, through band 50, through contact 100, and through actuate contact pin 105.

It will be appreciated that contact 100 is preferably flexible so as to deflect a small amount when hit by band 50 under force of acceleration from actuate roller 60. The flexibility may be achieved through a cantilever metallic structure, the metal being preferably beryllium copper, or through compressible conductive materials. It is preferred that the contact be plated with gold so as to assure low resistance electrical conduction when in contact with band 50. It will be appreciated that gold contact pads 230 in FIG. 2 are preferably plated on band 50 at a portion on band 50 that makes contact with contact 100.

It is preferable to fill the chamber within the housing between end caps 30 and 40 with a fluid. The fluid provides a dampening effect, gives an acceleration time integrating effect and reduces movement and vibration which can cause fatigue failures of the band. The fluid is preferably selected from a family of fluids having wide temperature ranges, wide selection choices of viscosity, and which are compatible and friendly with respect to corrosion or other degradation of the materials within the chamber. Typically a silicone-based oil is used. The chamber is filled with the oil through fluid fill port 120 and then fluid fill port 120 is sealed, but an air bubble is left in the chamber to provide for expansion or contraction resulting from an increase or decrease of temperature. It will be appreciated that the fluid is an electrical insulator.

Figure 2:
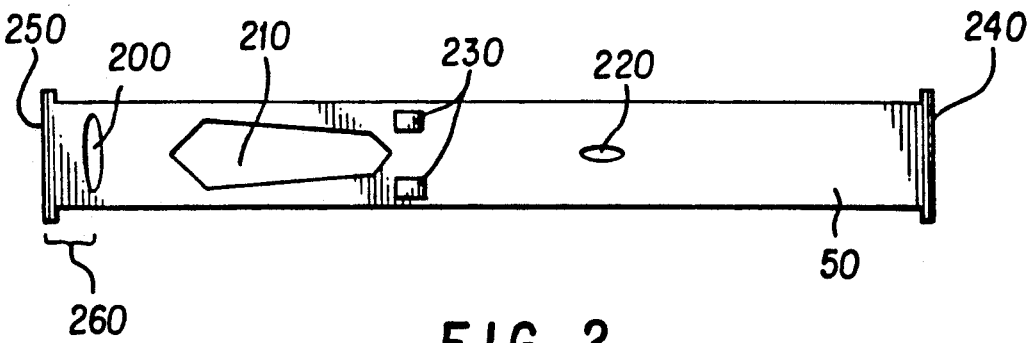
FIG. 2 is a top view of the band of FIG. 1 which is a preferred embodiment of the present invention.

In FIG. 2, a band of the present invention is shown. Gold contact pads 230, described above, are shown. Band 50 has force-generation cut out 210 for providing band 50, when operating in the Rolamite sensor, with a spring-like force. It will be appreciated by persons skilled in the art that band 50 stores energy (much like that of a conventional spring). Band 50, having a specific thickness, will tend to lay flat if subjected to no external forces, and will continue to want to resiliently flatten out when stretched around rollers 60 and 70. It will be further understood that thicker or wider portions of band 50 will exert stronger flattening forces than would be exerted by thinner or narrower portions of band 50. Thus, portions of band 50 adjacent to cut out 210 will exert a lesser flattening force proportional to the cross section area of band 50 taken through cut out 210 so that a taper in cut out 210 causes a flattening force to vary along band 50 based on an amount of taper in cut out 210. Accordingly, portions of band 50 adjacent to the force-generation cut out 210 and looped around actuate roller 60 will exert weaker flattening forces than the flattening forces exerted by portions of band 50 looped around reset roller 70. Therefore, band 50, when looped around rollers 60 and 70, will exert flattening forces on portions along band 50 that are bent. When force-generation cut out 210 is looped around actuate roller 60 so that a portion of band 50 adjacent to force-generation cut out 210 is also in contact with both actuate roller 60 and bottom wall 20, and there is no cut out in band 50 at a portion where band 50 is in contact with reset roller 70 and top wall 10, the portion of band 50 in contact with bottom wall 20 will exert a smaller flattening force than the flattening force exerted by a portion of band 50 in contact with top wall 10. Accordingly, rollers 60 and 70 are urged against guard 90. When housing 5 is subjected to acceleration in a direction extending from actuate end cap 30 to reset end cap 40, rollers 60 and 70 will be displaced in a direction from reset end cap 40 toward actuate end cap 30 by a distance based on a difference between the flattening force exerted by band 50 at portions in contact with bottom wall 20 and top wall 10, and also based on the inertia of rollers 60 and 70 and the acceleration.

Note that fluid in the housing chamber on the actuate end cap side of rollers 60 and 70 is impeded from flowing through band 50 to the reset end cap side. Accordingly, resisting forces will be encountered. To control these fluid resisting forces, band 50 is provided with a fluid metering cut out 220 to regulate the flow of fluid from one side to the other of rollers 60 and 70 according to the size of cut out 220 and the viscosity of the fluid. In order to facilitate flow of fluid to one side of the chamber to the other, roller 70 is preferably provided with a circumferential groove at a position coincident with fluid metering cut out 220, thus, roller 70 appears in a dumbbell like shape.

In conventional Rolamite sensors, sufficient acceleration of the sensor can cause band 50 to break at a weakest portion where a cross sectional area of band 50 is smallest. In a conventional band the weakest portion is adjacent to force-generation cut out 210. When this occurs in conventional Rolamite sensors, electrical conductive paths may still exist between reset pin 80 and actuate contact pin 105. Therefore, conduction through the Rolamite sensor is unpredictable, because it may fail in an open, i.e., safe, or a short, i.e., unsafe, circuit condition.

In order to achieve failsafe operation by assuring that a Rolamite sensor fails in an open circuit condition when subjected to a predetermined acceleration, band 50 is provided with safe cut out 200 positioned a predetermined distance from reset end 250 defining reset portion 260 between the safe cut out 200 and reset end 250. The safe cut out 200 is preferably positioned so that reset portion 260 is located between protruding portion 95 of guard 90 and bottom wall 20. Failsafe operation may be achieved when the end of protruding portion 95 extends further from reset end cap 40 than safe cut out 200 extends from reset end cap 40 so that portion 260 is covered and protected by portion 95 of guard 90.

Safe cut out 200 is preferably elliptical in shape, because the elliptical shape of the cut out provides good predictability of the parting force required to break the band. By locating safe cut out 200 between protruding portion 95 of guard 90 and bottom wall 20 and disposing guard 90 of insulating material between a portion of band 50 looped around reset roller 70 and reset end cap 40, reset pin 80 and reset end cap 40 are, without fail, electrically isolated from contact 100 and actuate contact pin 105 when a predetermined acceleration is applied to housing 5 sufficient to break band 50 at cut out 200. Accordingly, the Rolamite sensor of the present invention provides an open circuit failsafe operation when subjected to a predetermined acceleration. Multiple failsafe cut outs or perforations of any shape may be provided in a band disposed along a longitudinal or transverse direction of the band so that a failsafe operation may be achieved when the band is broken at the multiple failsafe cut outs. The combined effect of the multiple small cut outs, constituting a perforation, is substantially the same as a large failsafe cut out.

Figure 3A:
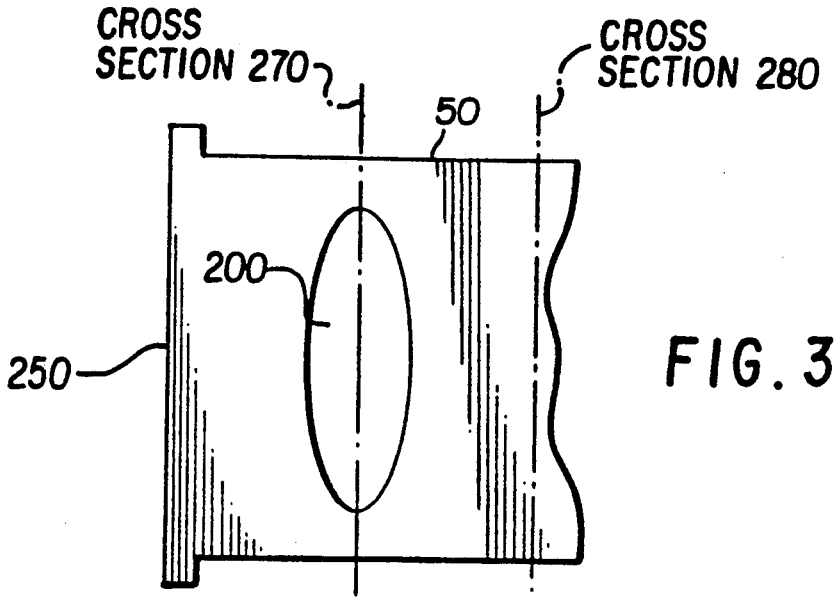
FIGS. 3A and 3B are views of a portion of the band with a cut out as a means for breaking.
Figure 3B:
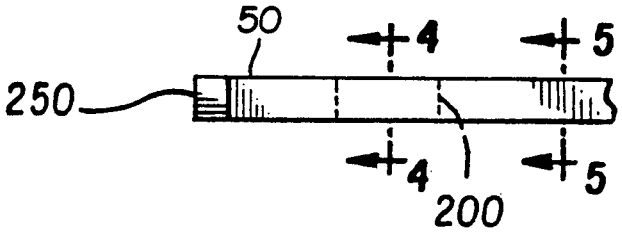
Figure 4:
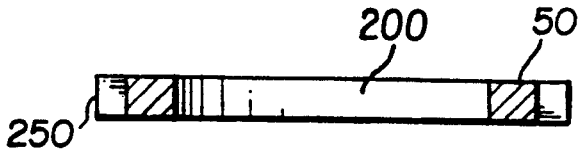
FIG. 4 is a section view through the band at a position of a safe cut out.
Figure 5:
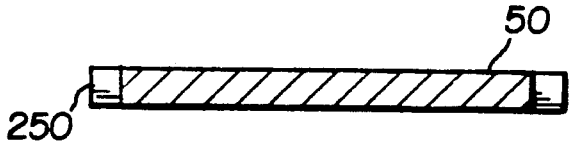
FIG. 5 is a section view through the band at a position other than a position of a safe cut out.

In FIGS. 3A and 3B it will be appreciated that an area of cross section 270 (shown in FIG. 4) extending through safe cut out 200 is smaller than an area of a cross section of band 50 (shown in FIG. 5) through any other position or cut out in band 50, for example cross section 280.

In a second embodiment of the present invention, force-generation cut out 210 is replaced by a different force-generation means. The force-generation means is a taper in a thickness of the roller band where the thickness of the roller band varies from a first thickness at reset end 250 to a second thickness at actuate end 240. It will be appreciated that the varying thickness of band 50 provides the same differences in flattening forces that would be provided in band 50 at a first portion adjacent to force-generation cut out 210 and a second portion of band 50 having no cut out.

TABLE 1

| Rolamite | Failure Acceleration at Force-Generation Cut out (Gs) | Failure Acceleration at Failsafe Cut out (Gs) |
|---|---|---|
| Prior Art | 2000 | — |
| Invention | 2000 | 1000 |

In prior roller band type acceleration sensors, when an excessive acceleration occurred the band would break at force-generation cut out 210 or fluid metering cut out 220. When this failure occurred, the sensor would have a chance of failing in a closed or an open position depending on how the band broke and where it was positioned at the time. With the present invention, there is no question that the sensor will fail in an open position.

As shown in TABLE 1 for illustration purposes, a prior art Rolamite sensor would fail at the force-generation cut out 210 at 2000 G. The present invention, on the other hand which would ordinarily fail at the force-generation cut out 210 at 2000 G, will fail at the failsafe cut out 200 at 1000 G. This ensures that the failsafe cut out 200 will fail prior to the force-generation cut out 210.

FIG. 1 shows a Rolamite acceleration sensor in a non-actuated state wherein the band 50 provides a certain force such that the rollers 60, 70 are held in a position as shown. Roller 70 is resting against the reset end cap 40 and bottom wall 20. Roller 60, because of tension of the band 50, is suspended above bottom wall 20 and pressed against wall 10. When the sensor is not actuated, electrical energy in pin 80 may be transferred through band 50 and to actuate end cap 30.

When the sensor is subjected to an acceleration sufficient to overcome the spring-like qualities of the band 50, the rollers 60 and 70 begin to roll towards contact 100 which flexes band 50 at various portions along the band length. If a large enough acceleration occurs, the portion of band 50 looped around roller 60 engages with contact 100 to establish electrical contact.

When the band 50 engages contact 100, an electrical circuit is created between conductive reset pin 80 through band 50 and contact 100 to actuate contact pin 105. This electrical circuit is used as an indication that a certain acceleration is occurring.

When an excessive acceleration occurs, band 50 of the sensor breaks at failsafe cut out 200. When the band 50 breaks, the two rollers 60, 70 are left sitting on top of the band 50. Neither roller is suspended any more because there is no longer any tension in band 50. No electrical energy can flow because the band, which is an integral part of the electrical circuit has been broken. The protruding portion 95 of guard 90 ensures that when band 50 breaks, no electrical contact is possible.

It will be appreciated that actuator end 240 of band 50 may be conductively fixed to actuate end cap 30 so that the conduction between actuate end cap 30 and reset end cap 40 is always maintained before conduction through band 50 is broken, regardless of whether conduction can occur between contact 100 and reset end cap 40, and conduction is permanently broken when acceleration has caused band 50 to break. Thus, conduction between end caps 30 and 40 indicate Rolamite sensor failure status independently of acceleration caused connection between contact 100 and any other part.

The invention as described has been designed to have a margin of safety between the G level at which the band breaks at the failsafe cut out and the G level at which the band would break at the force-generation cut out. The margin of safety can be designed to be any ratio. In the illustrative design described (Table 1) the margin of safety is 2:1. The margin of safety is a design variable for a particular application, size and force level.

The disclosed preferred embodiment of the present invention as set forth herein is intended to be illustrative, not limiting. Various changes may be made without departing from the spirit and scope of the present invention as defined in the following claims.

What is claimed is:

1. A roller band acceleration sensor comprising:

(a) an elongated housing of insulating material;

(b) a reset end cap of conductive material disposed on a first end of said housing;

(c) an actuate end cap of conductive material disposed on a second end of said housing;

(d) two rollers disposed within said housing between the first and the second ends of said housing;

(e) a band of conductive material looped in a generally S-shaped fashion about said two rollers, said band having a reset end connected to said reset end cap, an actuate end connected to said actuate end cap, and a breaking means for breaking electrical conduction between said reset end cap and said actuate end cap when said housing is subjected to a predetermined shock acceleration, said breaking means defining a reset portion of said band between said reset end and said breaking means; and (f) insulating means for insulating said reset end cap and said reset portion from all remaining portions of said band when said breaking means breaks electrical conduction between said reset end cap and said actuate end cap.

2. The roller band acceleration sensor of claim 1, wherein said insulating means is a guard of insulating material disposed on said reset end cap to insulate said reset end cap from said all remaining portions of said band.

3. The roller band acceleration sensor of claim 2, wherein said breaking means is a safe cut out formed in said band, the safe cut out being disposed under a protruding portion of said guard.

4. The roller band acceleration sensor of claim 3, wherein an area of a cross section of said band through the safe cut out is smaller than an area of a cross section of said band through any other cut out in said band.

5. The roller band acceleration sensor of claim 3, wherein said safe cut out has an elliptical shape.

6. A roller band acceleration sensor, comprising:

(a) an elongated housing of insulating material;

(b) a reset end cap of conductive material disposed on a first end of said housing;

(c) an actuate end cap of conductive material disposed on a second end of said housing;

(d) two rollers disposed within said housing between the first and the second ends of said housing;

(e) a conductive band looped in a generally S-shaped fashion about said two rollers, said conductive band having a thickness which varies according to a predetermined taper from a first thickness at an actuate end of said conductive band to a second thickness at a reset end of said conductive band, the second thickness being thinner than the first thickness and said conductive band being connected at the reset end to said reset end cap; and (f) a contact formed on and insulated from said actuate end cap, said contact becoming conductive with said reset end cap when said housing is subjected to a predetermined acceleration.

7. A failsafe mechanism for a roller band sensor having an elongated housing of insulating material, a reset end cap and an actuate end cap of conductive material disposed at opposite ends of the housing, two rollers disposed within the housing between the reset and actuate end caps, and a band of conductive material looped in a generally S-shaped fashion about the two rollers and connected at a reset end of the band to the reset end cap and at an actuate end of the band to the actuate end cap, the failsafe mechanism comprising:

(a) breaking means provided in the band for breaking electrical conduction between the reset end cap and the actuate end cap when the housing is subjected to a predetermined shock acceleration, said breaking means defining a reset portion of the band between the reset end and said breaking means, said breaking means defining a remaining portion of the band between the actuate end and said breaking means; and (b) insulating means for insulating the reset end cap and the reset portion from the remaining portion of the band when said breaking means breaks electrical conduction between the reset end cap and the actuate end cap.

8. A band of conductive material having a reset end and an actuate end for a roller band sensor, the band comprising:

(a) a reset portion of the band defined between a breaking means provided in the band and the reset end of the band, the breaking means for breaking electrical conduction between the reset and actuate ends of the band when the roller band sensor is subjected to a predetermined shock acceleration; and (b) a remaining portion of the band defined between the breaking means and the actuate end of the band.

9. The band of claim 8, wherein the breaking means includes a failsafe cut out provided in the band.

10. The band of claim 9, wherein the remaining portion of the band includes a force-generation portion of the band having a force-generation cut out provided in the force generation portion.

11. An improvement for a roller band sensor having an elongated housing of insulating material, a reset end cap and an actuate end cap of conductive material disposed at opposite ends of the housing, two rollers disposed within the housing between the reset and actuate end caps, and a band of conductive material looped in a generally S-shaped fashion about the two rollers and connected at a reset end of the band to the reset end cap and at an actuate end of the band to the actuate end cap, the improvement comprising:

(a) breaking means provided in the band for breaking electrical conduction between the reset end cap and the actuate end cap when the housing is subjected to a predetermined shock acceleration, said breaking means defining a reset portion of the band between the reset end and said breaking means, said breaking means defining a remaining portion of the band between the actuate end and said breaking means; and (b) insulating means for insulating the reset end cap and the reset portion from the remaining portion of the band when said breaking means breaks electrical conduction between the reset end cap and the actuate end cap.

* * * * *